US006742749B2

(12) United States Patent
Kassai et al.

(10) Patent No.: US 6,742,749 B2
(45) Date of Patent: Jun. 1, 2004

(54) BABY'S PLAY GYM FOR SUSPENDING TOYS, RECONFIGURABLE AS A MAGAZINE RACK OR A CHAIR

(75) Inventors: Kenzou Kassai, Osaka (JP); Ichiro Onishi, Osaka (JP)

(73) Assignee: Aprica Kassai Kabushikikaisha, Osaka (JP)

( * ) Notice: Subject to any disclaimer, the term of this patent is extended or adjusted under 35 U.S.C. 154(b) by 0 days.

(21) Appl. No.: 10/312,649

(22) PCT Filed: May 17, 2002

(86) PCT No.: PCT/JP02/04825

§ 371 (c)(1),
(2), (4) Date: Dec. 26, 2002

(87) PCT Pub. No.: WO02/094406

PCT Pub. Date: Nov. 28, 2002

(65) Prior Publication Data

US 2003/0127573 A1 Jul. 10, 2003

(30) Foreign Application Priority Data

May 23, 2001 (JP) ..... 2001-154100

(51) Int. Cl.[7] ..... F16M 11/32

(52) U.S. Cl. ..... 248/163.2; 211/189; 297/448.1; 297/440.11; 446/227

(58) Field of Search ..... 248/163, 440, 248/440.1, 163.2, 105, 441.1; 211/189; 297/448.1, 440.11; 446/227

(56) References Cited

U.S. PATENT DOCUMENTS 2,736,131 A * 2/1956 Lewis, Jr. ..... 446/227
3,978,610 A * 9/1976 Stubbmann ..... 446/227
3,999,727 A * 12/1976 Rennemann ..... 206/298
4,205,876 A * 6/1980 Cetina ..... 297/118
4,234,134 A * 11/1980 Rhine ..... 242/423.1
4,553,786 A * 11/1985 Lockett et al. ..... 297/440.1
4,627,588 A 12/1986 Block
5,037,056 A * 8/1991 Thompson ..... 248/441.1
5,411,315 A * 5/1995 Greenwood ..... 297/440.24
6,325,348 B1 * 12/2001 Turner ..... 248/235
6,471,180 B1 * 10/2002 Cunningham ..... 248/640
6,478,281 B1 * 11/2002 Turner ..... 248/441.1
2001/0010351 A1 * 8/2001 Schutze ..... 248/441.1

FOREIGN PATENT DOCUMENTS

| | | |
|---|---|---|
| JP | 09084964 | 3/1997 |
| JP | 10192101 | 7/1998 |
| JP | 10192560 | 7/1998 |

* cited by examiner

*Primary Examiner*—Ramon O. Ramirez
*Assistant Examiner*—Kofi Schulterbrandt
(74) *Attorney, Agent, or Firm*—W. F. Fasse; W. G. Fasse

(57) ABSTRACT

A baby's play gym for supporting suspended toys can be reconfigured to form a magazine rack or a chair. The play gym includes upwardly convex arcuate first and second side supports arranged laterally opposite one another with a spacing distance therebetween. First and second hanger bars coupling the first and second side supports with each other for hanging toys thereon extend between upper portions of the first and second side supports. Third and fourth hanger bars for hanging other toys extend between lower portions of the first and second side supports. When reconfigured as a magazine rack or a chair, a strip member is supported from at least two of the hanger bars to form a sling trough to support books and magazines or a sling seat to support a person, while the play members are removed and some of the hanger bars may be removed.

14 Claims, 4 Drawing Sheets

BABY'S PLAY GYM FOR SUSPENDING TOYS, RECONFIGURABLE AS A MAGAZINE RACK OR A CHAIR

TECHNICAL FIELD

The present invention relates to a plaything employed indoors for a baby, and more specifically, it relates to a plaything capable of varying the form thereof in response to growth of the baby.

BACKGROUND ART

For example, Japanese Patent Laying-Open No. 10-192101 discloses a plaything employed indoors for a baby in general. Referring to FIG. 6, this plaything 200 comprises arcuate frame members 210 and 211, employed to cover a baby lying in bed, having upper end portions detachable from each other. Base members 212 and 213 couple the respective lower end portions of the frame members 210 and 211 with each other. Coupling members 214 and 215 are provided between the frame members 210 and 211. It is possible to amuse the baby nestling down in bed by hanging toys, dolls or the like on the frame members 210 and 211 or the coupling members 214 and 215 of the plaything 200 having such a structure.

Such a plaything is preferably employed for hanging toys or the like made of soft materials when the baby is still newborn, and preferably employed for hanging toys having some works, sounding toys or the like when the baby is in its infancy. When the baby is in its toddlerhood, it can practice standing up by holding on to the plaything employed for hanging toys or the like.

When the baby grows up to a certain age, the plaything employed in its infancy is no longer used. Consequently, this plaything is stowed away in a closet, or scrapped. However, this plaything symbolizes the possessor's remembrance of his/her childhood, i.e. the cerebral growth period when he/she enjoyed playing with the parents, and hence he/she can remember the pure love given by the parents and develop a warm heart by occasionally seeing or touching the plaything after growing up and recalling that he/she enjoyed playing with the parents. Further, the plaything can conceivably provide a stimulus effective for the growth of a human, particularly for the growth of the brain.

DISCLOSURE OF THE INVENTION

The present invention aims at providing a plaything having a structure capable of varying the form thereof to be keepable at hand after the growth of a baby so that the possessor can preserve the plaything employed in his/her infancy all his/her life long.

In order to attain the aforementioned object, the plaything according to the present invention, which is a plaything for hanging play members thereon, comprises first and second side supports oppositely arranged on both sides at a prescribed interval for forming side surfaces and at least two hanger bars provided coupling the aforementioned first side support and the aforementioned second side support with each other for hanging the aforementioned play members thereon.

When this plaything is employed to cover a baby lying in bed, the baby that cannot move around on its own can enjoy playing with the hung play members along with its parents who are affectionate toward it.

In the aforementioned plaything, the aforementioned first and second side supports preferably have upwardly convexed arcuate shapes. In the aforementioned plaything, further, the aforementioned hanger bars are preferably provided to be different in vertical position from each other. According to this structure, the vertical positions of the hanger bars so vary that the same can stimulate the playful mind of the baby and exert good influence on the growth of the brain.

The aforementioned plaything preferably includes first and second hanger bars coupling regions of the aforementioned first side support and the aforementioned second side support close to upper portions with each other and third and fourth hanger bars coupling the aforementioned first side support and the aforementioned second side support with each other on positions downward and outward beyond positions mounted with the aforementioned first and second hanger bars. According to this structure, positions of hung play members differ from each other while the play members are hung on four portions in plane, to be capable of further prompting the curiosity of the baby.

In the aforementioned plaything, the aforementioned hanger bars are preferably detachably provided with respect to the aforementioned first and second side supports. Further, the aforementioned plaything preferably further comprises a strip member to be hung on at least two hanger bars selected from the aforementioned hanger bars for supplying this plaything with the form of a magazine rack or a chair.

According to this structure, the possessor can use the plaything symbolizing the remembrance of his/her childhood, i.e. the cerebral growth period when he/she enjoyed playing with the parents, in the form of a magazine rack or a chair also after growing up, whereby he/she can keep this plaything at hand for occasionally seeing or touching this plaything. Consequently, the possessor can remember the pure love given by the parents and develop a warm heart by occasionally recalling that he/she enjoyed playing with the parents. Further, the plaything can provide an effective stimulus to the possessor in the process of growing up to an adult, particularly in the process of the cerebral growth. In addition, the possessor can preserve the plaything employed in his/her infancy all his/her life long.

BEST MODES FOR CARRYING OUT THE INVENTION

The structure of a plaything according to an embodiment of the present invention is now described with reference to the drawings. The plaything 100 according to this embodiment has a structure capable of changing the form thereof to the so-called play gym, a magazine rack and a chair. The structure of the plaything 100 is now described with reference to the respective forms.

Play Gym

Figure 1:
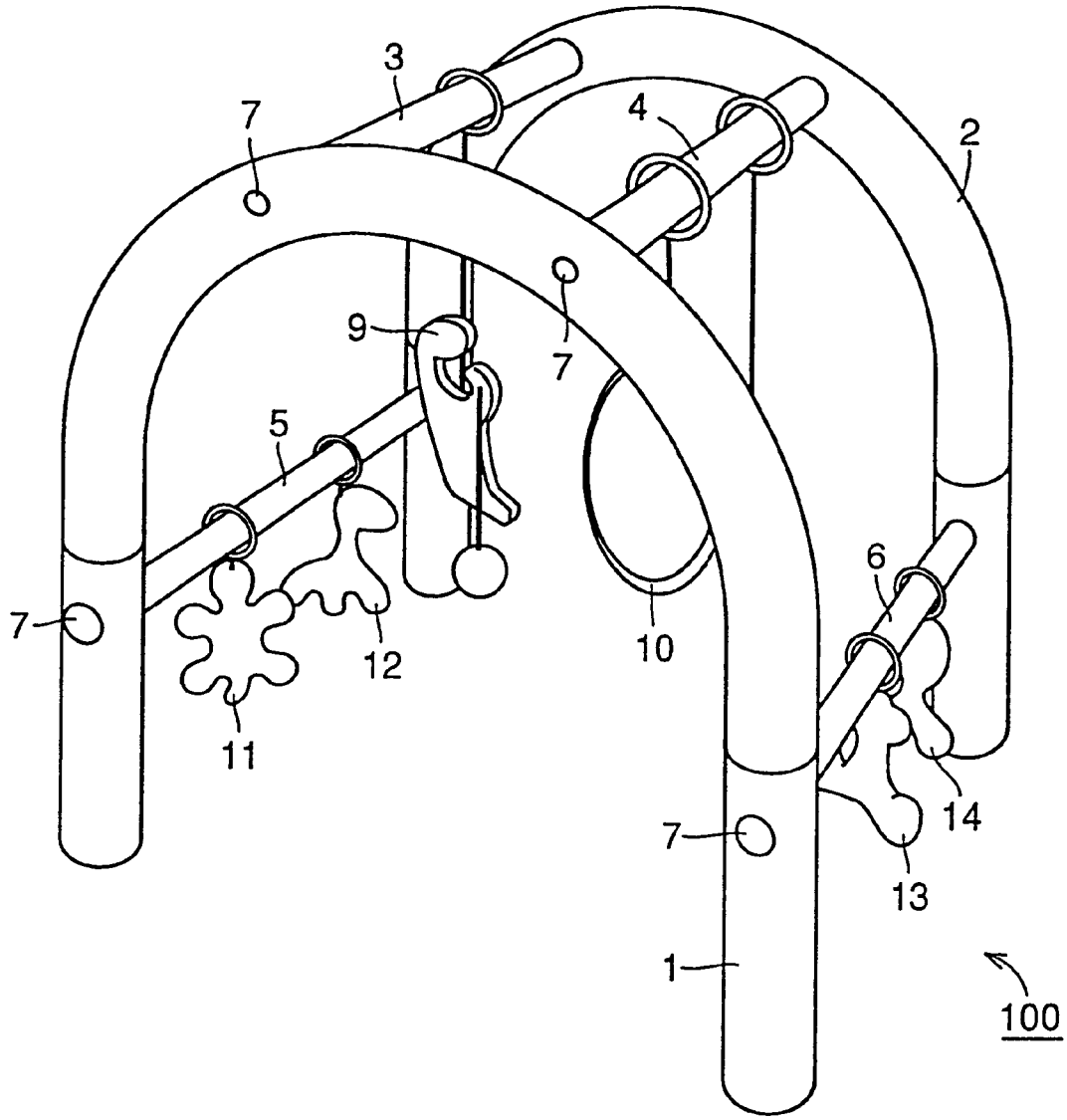
FIG. 1 is a perspective view showing the whole of a plaything 100 forming a play gym.

The structure of the plaything 100 forming a play gym is described with reference to FIG. 1. FIG. 1 is a perspective view showing the whole of the plaything 100 forming a play gym. This plaything 100 comprises a first side support 1 and a second side support 2 oppositely arranged on both sides at a prescribed interval for forming side surfaces. According to this embodiment, the first side support 1 and the second side support 2 have upwardly convexed arcuate frame structures.

A first hanger bar 3 and a second hanger bar 4 coupling the first side support 1 and the second side support 2 with each other for hanging play members thereon are provided on upper portions of the first side support 1 and the second side support 2. The first hanger bar 3 and the second hanger bar 4 are detachably provided with respect to the first side support 1 and the second side support 2 with screws 7 or the like. The first hanger bar 3 and the second hanger bar 4, provided to be parallel to each other on the same vertical positions with respect to the first side support 1 and the second side support 2 in this embodiment, can be rendered different in vertical position from each other, or can be obliquely mounted.

A third hanger bar 5 and a fourth hanger bar 6 for hanging play members thereon are also provided on lower portions of the first side support 1 and the second side support 2. The third hanger bar 5 and the fourth hanger bar 6 are mounted at positions downward below the first hanger bar 3 and the second side hanger bar 4 respectively, while the third hanger bar 5 is mounted at a position laterally outward beyond the first hanger bar 3 and the fourth hanger bar 6 is mounted at a position laterally outward beyond the second hanger bar 4. The third hanger bar 5 and the fourth hanger bar 6 are also detachably mounted with respect to the first side support 1 and the second side support 2 with screws 7 or the like.

In this embodiment, an object 9 of wood modeled on a mother is hung on the first hanger bar 3, a disk 10 forming a mirror is hung on the second hanger bar 4, and characters 11, 12, 13 and 14 consisting of soft materials modeled on imaginary animals are hung on the third hanger bar 5 and the fourth hanger bar 6 as the hung play members. The third hanger bar 5 and the fourth hanger bar 6, provided to be parallel to each other on the same vertical positions with respect to the first side support 1 and the second side support 2, can be rendered different in vertical position from each other, or can be obliquely mounted.

When the aforementioned plaything 100 forming a play gym is employed to cover a baby lying in bed, the baby that cannot move around on its own can enjoy playing with the hung play members along with its parents who are affectionate toward it. Further, the positions of the hanger bars so vary that the positions of the hung play members differ from each other while the play members are hung on four portions in plane, so that the plaything can further prompt the curiosity of the baby.

While the plaything employs four hanger bars in the above description, the number of the hanger bars is not restricted to four but can be arbitrarily selected so far as the plaything employs at least two hanger bars for rendering the first side support 1 and the second side support 2 self-supporting.

Magazine Rack

Figure 2:
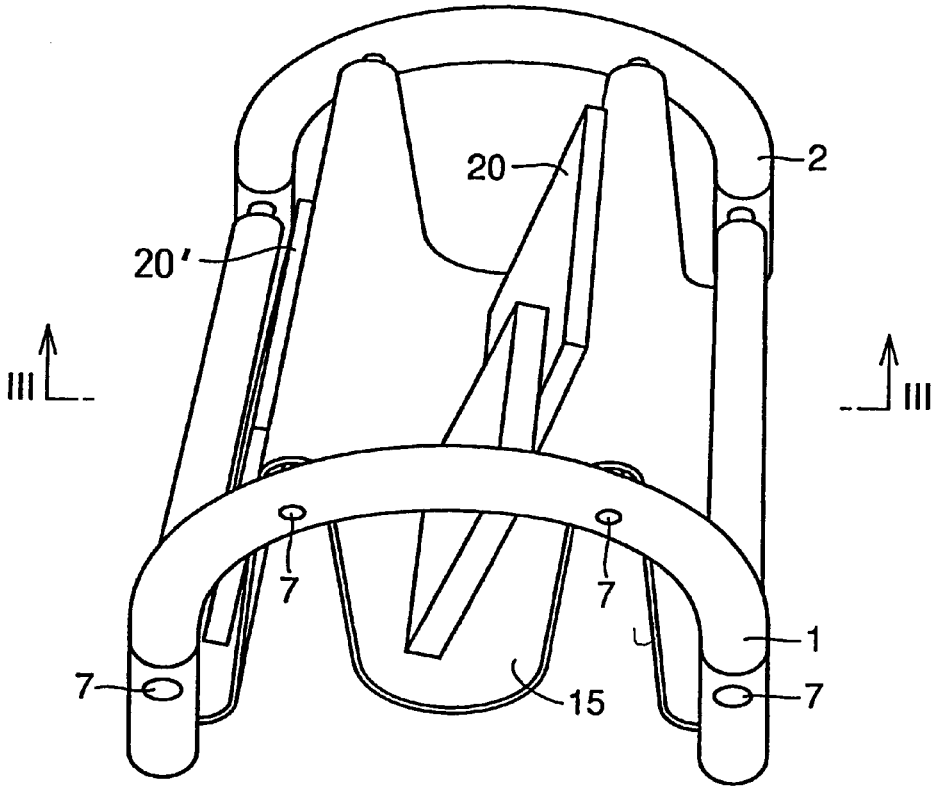
FIG. 2 is a perspective view showing the whole of the plaything 100 forming a magazine rack.

The structure of the plaything 100 forming a magazine rack is now described with reference to FIGS. 2 and 3. FIG. 2 is a perspective view showing the whole of the plaything 100 forming a magazine rack, and FIG. 3 is a sectional view taken along the line III—III in FIG. 2.

Figure 3:
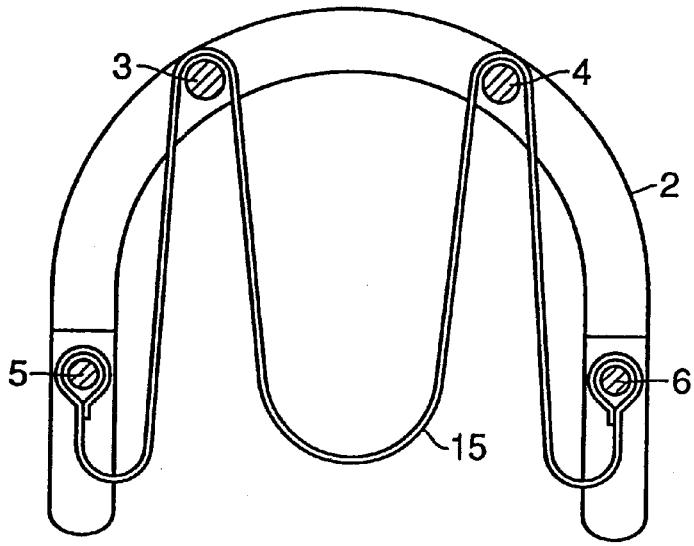
FIG. 3 is a sectional view taken along the line III—III in FIG. 2.

In the plaything 100 forming a magazine rack, the hung play members are removed, and both end portions of a strip member 15 consisting of cloth, vinyl or the like are fixed to the third hanger bar 5 and the fourth hanger bar 6 as shown in the sectional view of FIG. 3 so that the central region of the strip member 15 droops from the first hanger bar 3 and the second hanger bar 4. When the strip member 15 is employed in this manner for forming a sling trough as a storage space for supporting picture books 20 and a magazine 20', the plaything 100 can be employed as a magazine rack. While all hanger bars are employed in the state shown in FIGS. 2 and 3, the hanger bars can be selectively removed for forming a magazine rack in an arbitrary shape.

Chair

Figure 4:
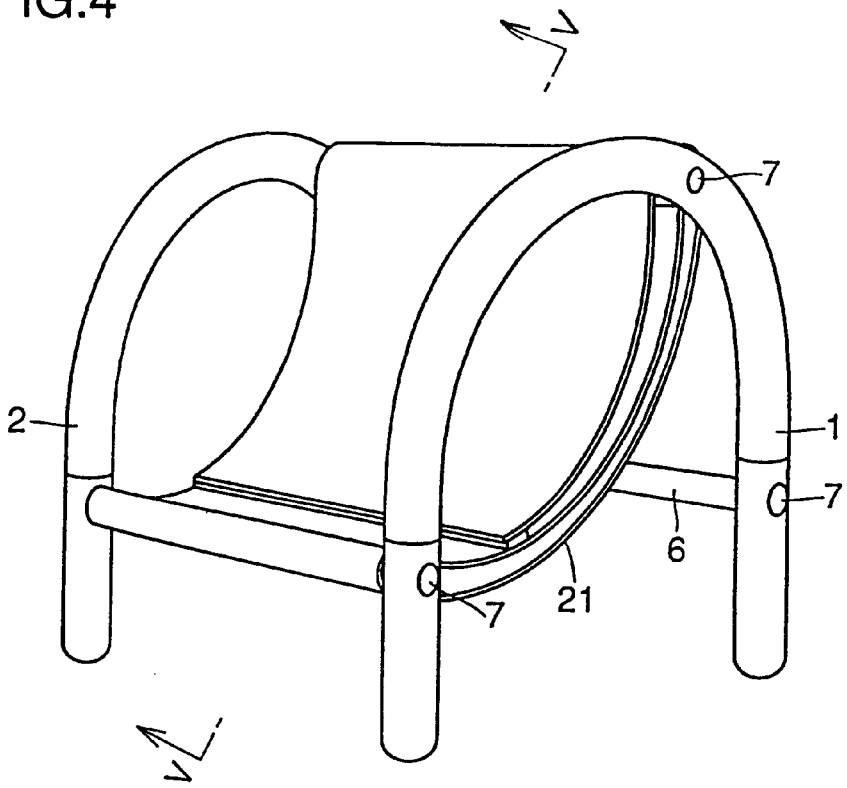
FIG. 4 is a perspective view showing the whole of the plaything 100 forming a chair.

The structure of the plaything 100 forming a chair is now described with reference to FIGS. 4 and 5. FIG. 4 is a perspective view showing the whole of the plaything 100 forming a chair, and FIG. 5 is a sectional view taken along the line V—V in FIG. 4.

Figure 5:
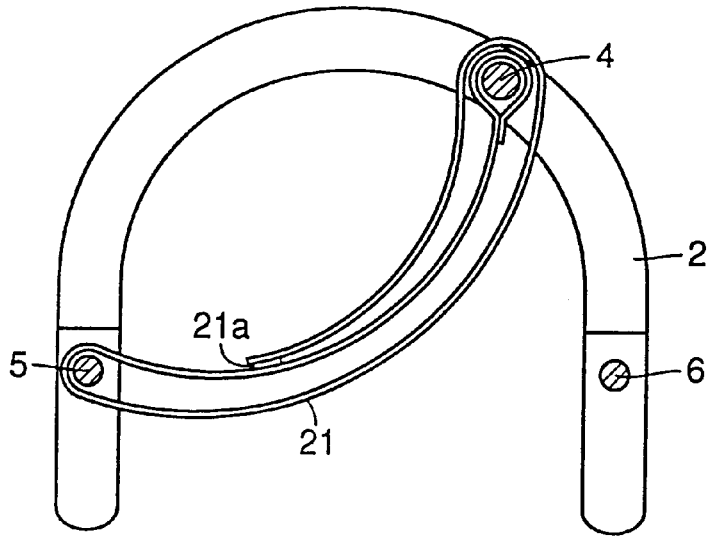
FIG. 5 is a sectional view taken along the line V—V in FIG. 4.
Figure 6:
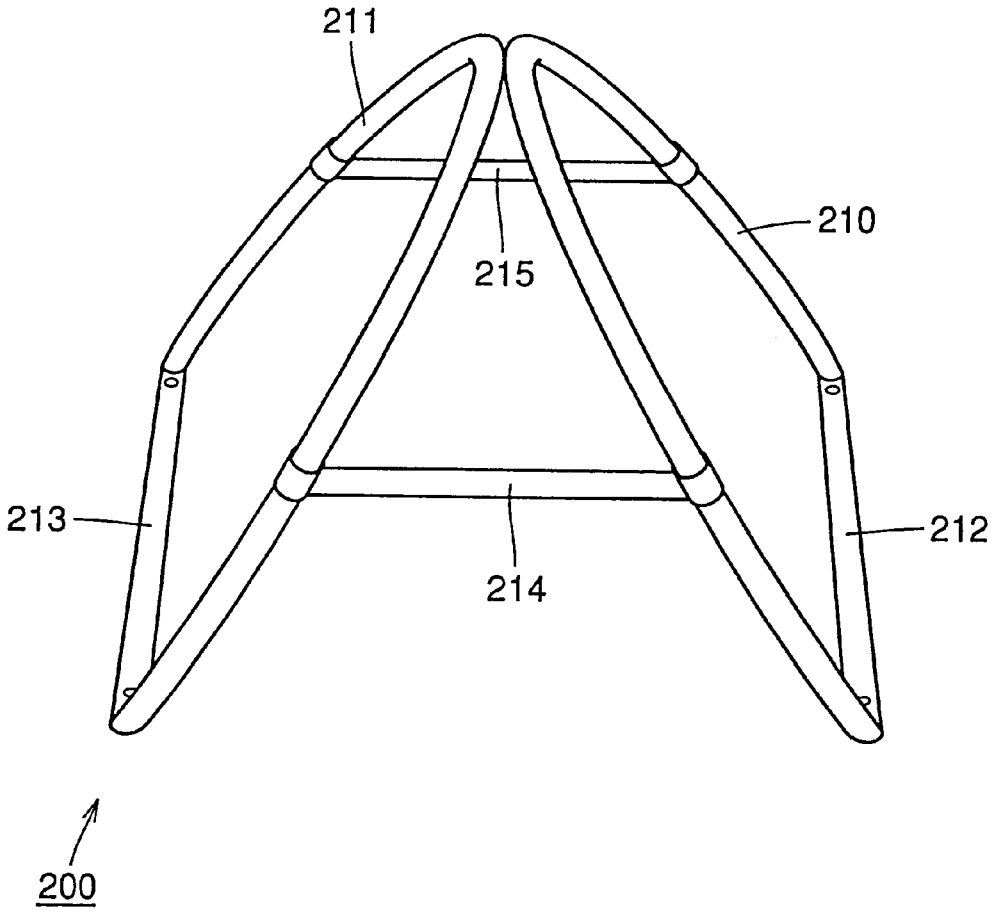
FIG.6 PRIOR ART
FIG. 6 is a perspective view showing the whole of a conventional plaything 200.

In the plaything 100 forming a chair, the play members to be hung and the first hanger bar 3 are removed, an end of a strip member 21 consisting cloth, vinyl or the like is fixed to the second hanger bar 4 as shown in the sectional view of FIG. 5, the strip member 21 is wound on the third hanger bar 5, the strip member 21 is further wound on the second hanger bar 4 and the other end of the strip member 21 is thereafter fixed to the strip member 21 with fixing members 2 la such as hooks.

When the strip member 21 is employed in this manner for forming a sling seat including a seat portion and a backrest for supporting a person seated thereon, the first side support 1 and the second side support 2 serve as armrests so that the plaything 100 can be employed as a chair.

Function/Effect

As hereinabove described, the form of the plaything 100 according to this embodiment can be changed into that of a play gym, that of a magazine rack and that of a chair. Thus, the possessor can use this plaything 100 symbolizing the remembrance of his/her childhood, i.e. the cerebral growth period when he/she enjoyed playing with the parents while changing the form also after growing up, whereby he/she can occasionally see or touch this plaything 100 by keeping this plaything 100 at hand. Consequently, the possessor can remember the pure love given by the parents and develop a warm heart by occasionally recalling that he/she enjoyed playing with the parents. Further, the plaything can provide an effective stimulus to the possessor in the process of growing up to an adult, particularly in the process of the cerebral growth. In addition, the possessor can preserve the plaything employed in his/her infancy all his/her life long.

The embodiment disclosed this time is illustrative in all points and not restrictive. The scope of the present invention is shown not by the above description but by the scope of claim for patent, and it is intended that all modifications within the meaning and the scope equivalent to the scope of claim for patent are included.

Industrial Applicability

The possessor of the plaything according to the present invention can use this plaything symbolizing the remembrance of his/her childhood, i.e. the cerebral growth period when he/she enjoyed playing with the parents, in the form of a magazine rack or a chair also after growing up, whereby he/she can keep this plaything at hand for occasionally seeing or touching this plaything. Consequently, the possessor can remember the pure love given by the parents and develop a warm heart by occasionally recalling that he/she enjoyed playing with the parents. Further, the plaything can provide an effective stimulus to the possessor in the process of growing up to an adult, particularly in the process of the cerebral growth. In addition, the possessor can preserve the plaything employed in his/her infancy all his/her life long.

What is claimed is:

1. A system of components forming a convertible article that can be selectively configured as a baby's play gym and as at least one of a magazine rack and a chair, comprising:

first and second side supports arranged spaced apart from one another;

a plurality of hanger bars that each extend between and interconnect said first side support and said second side support;

a plurality of baby's play toys; and a strip member;

wherein:

when said system of components is configured as said baby's play gym, said baby's play toys are suspended from one or more of said hanger bars; and when said system of components is configured as said magazine rack or as said chair, said strip member is secured to and suspended from at least two of said hanger bars to form a suspended sling of said strip member that is adapted to support at least one of magazines and books placed on said suspended sling or a person seated on said suspended sling.

2. The system of components according to claim 1, wherein further:

when said system of components is configured as said baby's play gym, said strip member is removed and separated from said hanger bars; and when said system of components is configured as said magazine rack or as said chair, said baby's play toys are removed and separated from said hanger bars.

3. The system of components according to claim 1, wherein said system of components can be configured as said magazine rack, wherein said suspended sling of said strip member forms a sling trough suspended from and hanging downwardly between two uppermost ones of said hanger bars, and wherein said sling trough is adapted to support the at least one of magazines and books placed in said sling trough.

4. The system of components according to claim 3, wherein said two uppermost ones of said hanger bars extend parallel to each other along a single common horizontal plane.

5. The system of components according to claim 3, wherein two ends of said strip member are respectively secured to two lowermost ones of said hanger bars, from which said strip member respectively extends over said two uppermost ones of said hanger bars to form said sling trough of said strip member suspended from and hanging downwardly between said two uppermost ones of said hanger bars.

6. The system of components according to claim 1, wherein said system of components can be configured as said chair, wherein said suspended sling of said strip member forms a sling seat suspended from and hanger between respective higher and lower ones of said hanger bars respectively at different heights, and wherein said sling seat is adapted to support the person seated on said sling seat.

7. The system of components according to claim 6, wherein a greater number of said hanger bars are secured to and extend between said first and second side supports when said system of components is configured as said baby's play gym, and a lesser number of said hanger bars less than said greater number are secured to and extend between said first and second side supports when said system of components is configured as said chair.

8. The system of components according to claim 1, wherein said plurality of hanger bars includes respective ones of said hanger bars arranged at different vertical heights.

9. The system of components according to claim 1, wherein said plurality of hanger bars includes two upper hanger bars parallel to each other on a first horizontal plane and two lower hanger bars parallel to each other on a second horizontal plane below said first horizontal plane.

10. The system of components according to claim 9, wherein said two lower hanger bars are spaced farther apart from each other and are located farther outwardly than are said two upper hanger bars.

11. The system of components according to claim 1, wherein said hanger bars are removably secured to said first and second side supports.

12. The system of components according to claim 1, wherein each one of said side supports has an upwardly convex arcuate shape.

13. The system of components according to claim 12, wherein said upwardly convex arcuate shape comprises a semicircular arc shape.

14. The system of components according to claim 1, wherein said strip member consists of cloth or vinyl and has a strength sufficient to support the at least one of magazines and books or the person.

* * * * *

UNITED STATES PATENT AND TRADEMARK OFFICE

CERTIFICATE OF CORRECTION

PATENT NO. : 6,742,749 B2
DATED : June 1, 2004
INVENTOR(S) : Kassai et al.

It is certified that error appears in the above-identified patent and that said Letters Patent is hereby corrected as shown below:

Column 3,
Line 28, after "second", delete -- side --;

Column 4,
Line 28, before "such", replace "2 1a" by -- 21a --;
Line 59, delete -- Industrial Applicability --;

Column 5,
Line 29, after "sling", insert -- , wherein said strip member can be suspended from at least one same one of said hanger bars from which said baby's play toys can be suspended when said system of components is configured as said baby's play gym. --

Signed and Sealed this

First Day of February, 2005

JON W. DUDAS
*Director of the United States Patent and Trademark Office*